US005483892A

United States Patent [19]

Stiel

[11] Patent Number: 5,483,892

[45] Date of Patent: Jan. 16, 1996

[54] DEVICE FOR SUPPLYING PRINTING PLATES TO A PLATE CYLINDER AND FOR CARRYING THE SAME AWAY FROM THE PLATE CYLINDER

[75] Inventor: Jürgen A. Stiel, Ostheim, Germany

[73] Assignee: Koenig & Bauer Aktiengesellschaft, Wurzburg, Germany

[21] Appl. No.: 397,070

[22] PCT Filed: Sep. 17, 1993

[86] PCT No.: PCT/DE93/00881

§ 371 Date: Mar. 16, 1995

§ 102(e) Date: Mar. 16, 1995

[87] PCT Pub. No.: 94/06631

PCT Pub. Date: Mar. 31, 1994

[30] Foreign Application Priority Data

Sep. 18, 1992 [DE] Germany ..... 42 31 901.3

[51] Int. Cl.[6] ..... B41F 27/06

[52] U.S. Cl. ..... 101/477; 101/415.1

[58] Field of Search ..... 101/130, 132.5, 101/132, 141–144, 136, 233, 234, 216, 137, 138, 415.1, 477, 483, 485, 486

[56] References Cited

U.S. PATENT DOCUMENTS

| | | | |
|---|---|---|---|
| 3,793,950 | 2/1974 | Kameko et al. | 101/130 |
| 5,111,744 | 5/1992 | Wieland | 101/2.6 |
| 5,127,328 | 7/1992 | Wieland | 101/415.1 |

FOREIGN PATENT DOCUMENTS

| | | |
|---|---|---|
| 0432660 | 12/1990 | European Pat. Off. . |
| 0433798 | 12/1990 | European Pat. Off. . |
| 62-248834 | 11/1986 | Japan . |

*Primary Examiner*—Ren Yan
*Attorney, Agent, or Firm*—Jones, Tullar & Cooper

[57] ABSTRACT

A device for supplying and removing printing plates in a rotary printing press having a plate cylinder utilizes a storage container which has a printing plate supply compartment and a printing plate removal compartment. An undivided guide compartment is provided beneath the supply and removal compartments. Guide elements are placed at the mouths of the plate supply and removal compartments and direct the printing plates into and out of the appropriate compartments.

8 Claims, 7 Drawing Sheets

DEVICE FOR SUPPLYING PRINTING PLATES TO A PLATE CYLINDER AND FOR CARRYING THE SAME AWAY FROM THE PLATE CYLINDER

FIELD OF THE INVENTION

The invention relates to a device for supplying printing plates to, and removing them from a plate cylinder of a rotary printing press.

DESCRIPTION OF THE PRIOR ART

A device for supplying and removing printing plates in rotary printing presses with a plate cylinder is known from JP 61-248834 A. The supply and removal of the printing plate from the plate cylinder takes place in this prior art device using one compartment of a longitudinally divided storage compartment.

It is disadvantageous in this prior art device that the gripper device for the leading edge of the printing plate and the gripper device for the end of the printing plate must exactly or precisely approach the lower opening of the respective supply or removal compartment.

SUMMARY OF THE INVENTION

It is the object of the present invention to provide a device for supplying printing plates to and removing them from a plate cylinder. The device in accordance with the present invention is designed in a space-saving manner and by means of which the plate changing operations can be performed in a short time.

Printing plates being supplied to and removed from a plate cylinder are stored in separate compartments of a storage container. One compartment is the supply compartment and the other is the removal compartment. An undivided guide compartment leading to the plate cylinder is located adjoining the supply and removal compartments.

The following advantages in particular are realized by the present invention. It is possible to temporarily store the printing plate because of the disposition of a longitudinally divided storage compartment. Guide plates disposed in the axial direction and pointing into the discharge compartment are provided for this purpose. The supply compartment is closed to printing plates to be removed toward the guide compartment by means of guide elements which are resilient toward one side, so that the supply compartment and the removal compartment can terminate in a space-saving manner in only a single guide compartment. It is possible to realize the position of the plate cylinder in regard to the removal and supply of plates in only two cylinder positions and thus in a short time. These operational steps are open print end, remove leading print edge, insert leading print edge, print end.

BRIEF DESCRIPTION OF THE DRAWINGS

The invention will be described in detail below by means of several exemplary embodiments. In the associated drawings are shown in.

DESCRIPTION OF THE PREFERRED EMBODIMENTS

Figure 1:
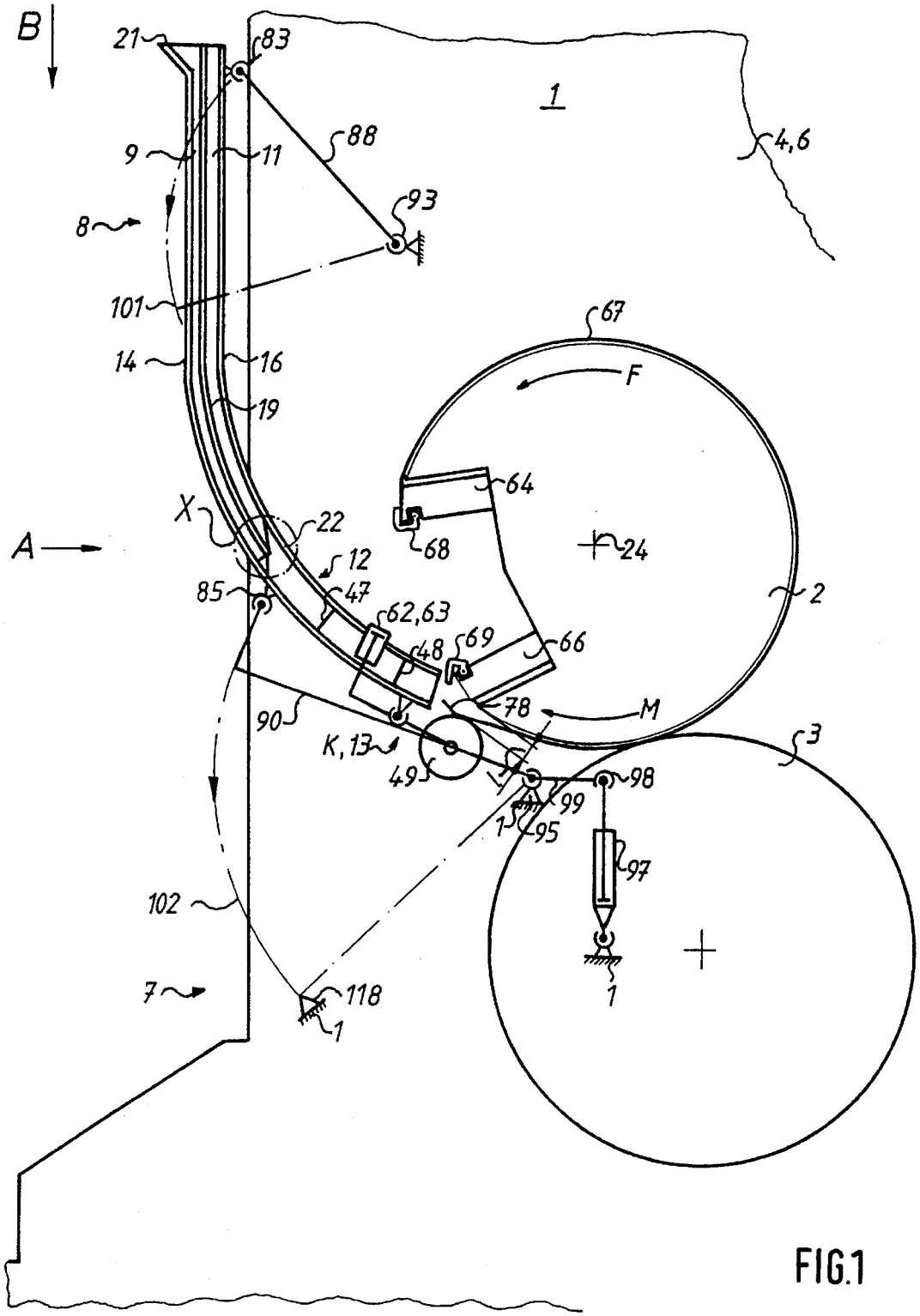
FIG. 1, a schematic side view of the device of the invention with a printing plate in the removal position.

A rotary printing press has several printing units, for example four printing units which, among other things, each typically contain a plate cylinder 2 and a rubber blanket cylinder 3, and of which one printing unit 1 is illustrated, as seen in FIG. 1. These cylinders 2, 3 are customarily seated in side frames 4, 6 of the rotary printing press by means of journals. The device of the invention is provided on an access side 7 to the cylinders 2, 3.

The device essentially consists of a storage compartment or container 8 with two partial compartments, a supply compartment 9 and a removal compartment 11. A compartment 12 is situated adjoining these tow compartments and disposed below them. A roller 13 for guiding and applying a printing plate is also provided.

Figure 2:
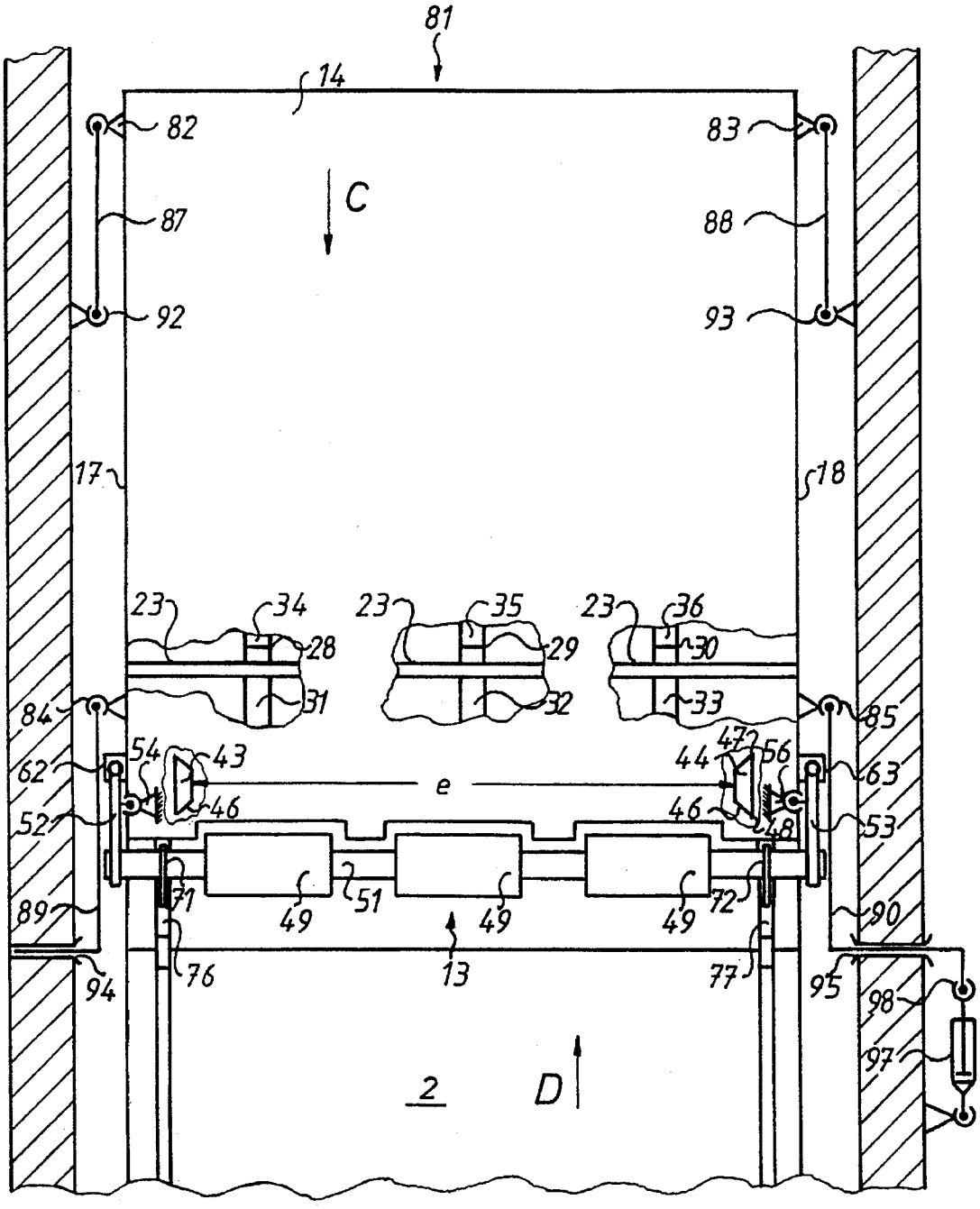
FIG. 2, a view taken in the direction indicated by arrow A in accordance with FIG. 1.
Figure 3:
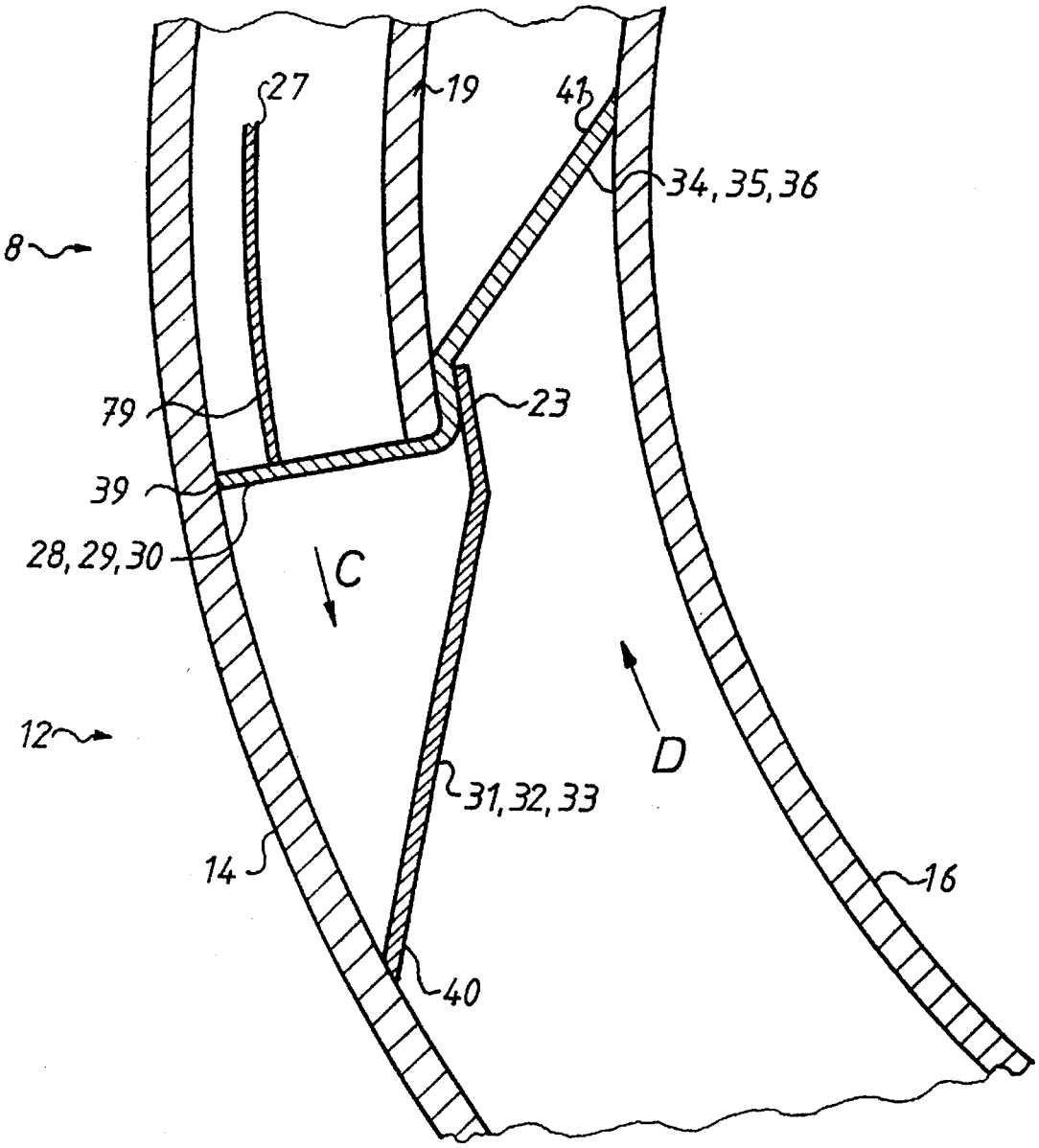
FIG. 3, an enlarged representation of a detail taken at X in accordance with FIG. 1.

The storage compartment or container 8 has a front wall 14 and a rear wall 16 which extend parallel with each other and which are connected with each other by means of lateral plates, not shown, at the side edges 17, 18, which are shown in FIG. 2. The supply compartment 9 and the removal compartment 11 are separated by an intermediate wall 19 extending parallel with the walls 14, 16 and extending through the storage container 8 from a first, upper end 21 to a second, lower end 22. The intermediate wall 10 terminates at the second end 22 of the storage compartment or container 8 at or in a strip 23 extending in the axial direction in relation to the cylinders 2, 3 and being fastened on the lateral plates of the side edges 17, 18 of the storage compartment 8 as seen in FIG. 3. This strip 23 separates the storage compartment 8 from the guide compartment 12, i.e. the storage compartment 8 terminates and the guide compartment 12 begins at this place. The guide compartment 12 is also formed by the front wall 14 extending in the direction of the cylinders 2, 3 and by the rear wall 16 and the lateral plates at the side edges 17, 18. The guide compartment 12 accordingly extends from the strip 23 in a slightly curved shape in the direction of the plate cylinder 2, with a radius which approximately corresponds to the radius of the plate cylinder 2, as far as shortly in front of an axially extending generator line on the plate cylinder 2 below its axis of rotation 24. The strip 23 has guide elements or guide plates 28 to 36, which respectively can be designed strip-shaped, as seen in FIG. 2 and can consist of spring steel. The guide plates 28 to 30 are embodied as support plates which extend in a radial direction in respect to the plate cylinder 2 or transversely to the direction of movement B of a fresh printing plate 27 to be supplied, and rest with their ends 39 on the inside against the front wall 14. Their two ends 39 can be pivoted around the strip 23 in the direction C shown in FIG. 3 under a load. By actuating the printing plate 27 in the direction of the arrow B, as depicted in FIG. 1, the three axially spaced apart strip-shaped guide plates 28, 29, 30 are displaced in the direction of the arrow C and permit the printing plate 27 to pass downwardly in this direction of travel B. Guide plates 31, 32, 33 are furthermore disposed on the strip 23 and extend between the front wall 14 and the rear wall 16 in the direction of the plate cylinder 2 and rest with their ends 40 on the inside against the front wall 14 of the guide compartment 12. In this manner the guide plates 31 to 33 act as shunts which spring back on one side and which make the supply compartment 9 passable for printing plates only in one direction C and close it off to printing plates taken off the plate cylinder 2 and coming from the direction D to prevent these plates from entering the supply compartment 9. Furthermore, the guide plates 34 to 36, also fastened on the strip 23, point in the direction of the first or upper end 21 of the storage compartment 8 and rest with their ends against the inside of the rear wall 16, so that the removal compartment 11 is closed, viewed from the direction of its first or upper end 21. Therefore a printing plate coming from the direction of the arrow D from the plate cylinder 2 can be parked on the guide plates 34 to 36 after having passed them, until it is removed from the removal compartment 11. In this way the guide plates 34 to 36 are used as blocking elements against printing plates 27 accidentally inserted into this removal compartment 11 and therefore as a one-way passage for printing plates to be removed.

The guide plates 28 to 30, 31 to 33 and 39 to 41 can also be made of one piece, i.e. continuous. The guide plates 28 to 30, arranged in the radial direction, can be omitted if the closing force of the guide plates 31 to 33 acting as a shunt is large enough that a printing plate resting between the inside of the front wall 14 and the ends 40 of the guide plates 31 to 33 passes in the direction C only against the action of a force to be additionally exerted.

The strip 23 extending in the axial direction could furthermore have an axis of rotation also extending in an axial direction, around which the strip 23 is embodied to be pivotable. In this case the guide plates 28 to 30 can be omitted and the guide plates 31 to 33 and 34 to 36 could be made of a nonresilient material and could be pressed against the insides of the front wall 14 or the rear wall 16 against the force of springs, for example extension springs, so that again a resilient disposition of the guide plates 31 to 36 as a whole would be achieved.

Guide elements 43, 44, whose thickness corresponds to the distance between the front wall 14 and the rear wall 16, are disposed inside the guide compartment 12 and shortly before its termination in the direction of the plate cylinder 12 in the vicinity of the side edges 17, 18. A distance "e" between the guide elements 43, 44 (FIG. 2) corresponds to the width of a printing plate 27. On their facing sides, the guide elements 43, 44 have round or tapered areas 46 which make possible the centering of the printing plate 27 when removing it from the plate cylinder 2 to the guide compartment 12 in the direction of the arrow D. This also applies for centering during the supply of printing plates 27 from the guide compartment 12 to the plate cylinder 2 in the direction of the arrow C. The guide elements 43, 44 disposed in the guide compartment 12 have a first end 47 and a second end 48, viewed in the direction of the arrow C.

Figure 4:
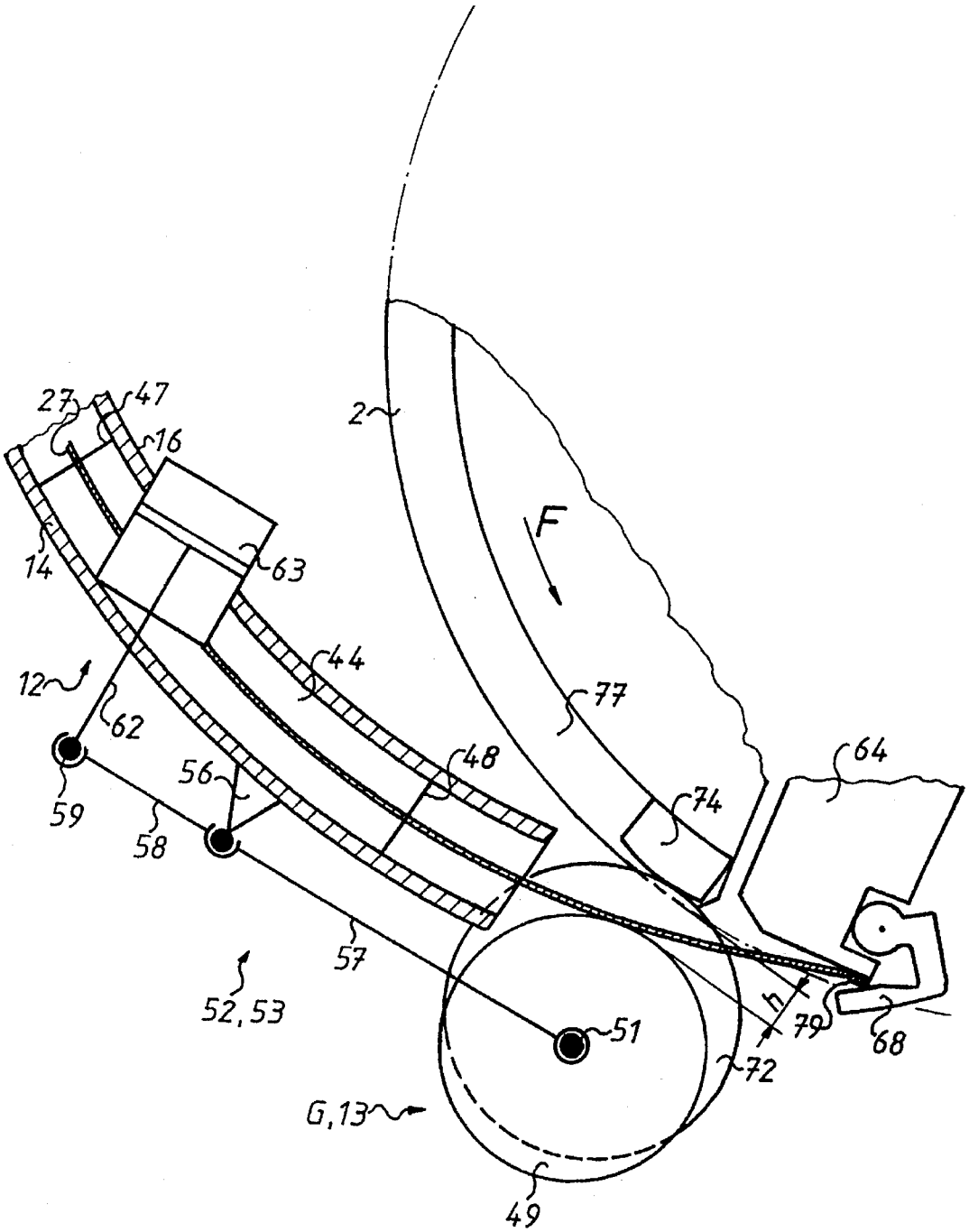
FIG. 4, an enlarged representation of the guide compartment as well as the cylinder device in accordance with FIG. 1, but with a printing plate in the supply position.

A plate drive roller 13, which consists of a rubber roller 49 rotatably seated on a shaft 51, is shown in the representations of FIGS. 1, 2 and 4. As shown in FIG. 2, the rubber roller 49 can also be divided in the axial direction and consists of three individual parts 49, for example. The shaft 51 is seated on both sides in two-armed levers 52, 53, which have a bearing point 54, 56 approximately centered at the side edges 17, 18 of the guide compartment 12. First arms 57 of the levers 52, 53 support the shaft 51 and second arms 58 are connected via joints 59 and piston rods 61 with position elements 62, 63, for example double-acting pneumatic cylinders, respectively fastened on the side edges 17, 18 of the guide compartment 12.

Figure 5:
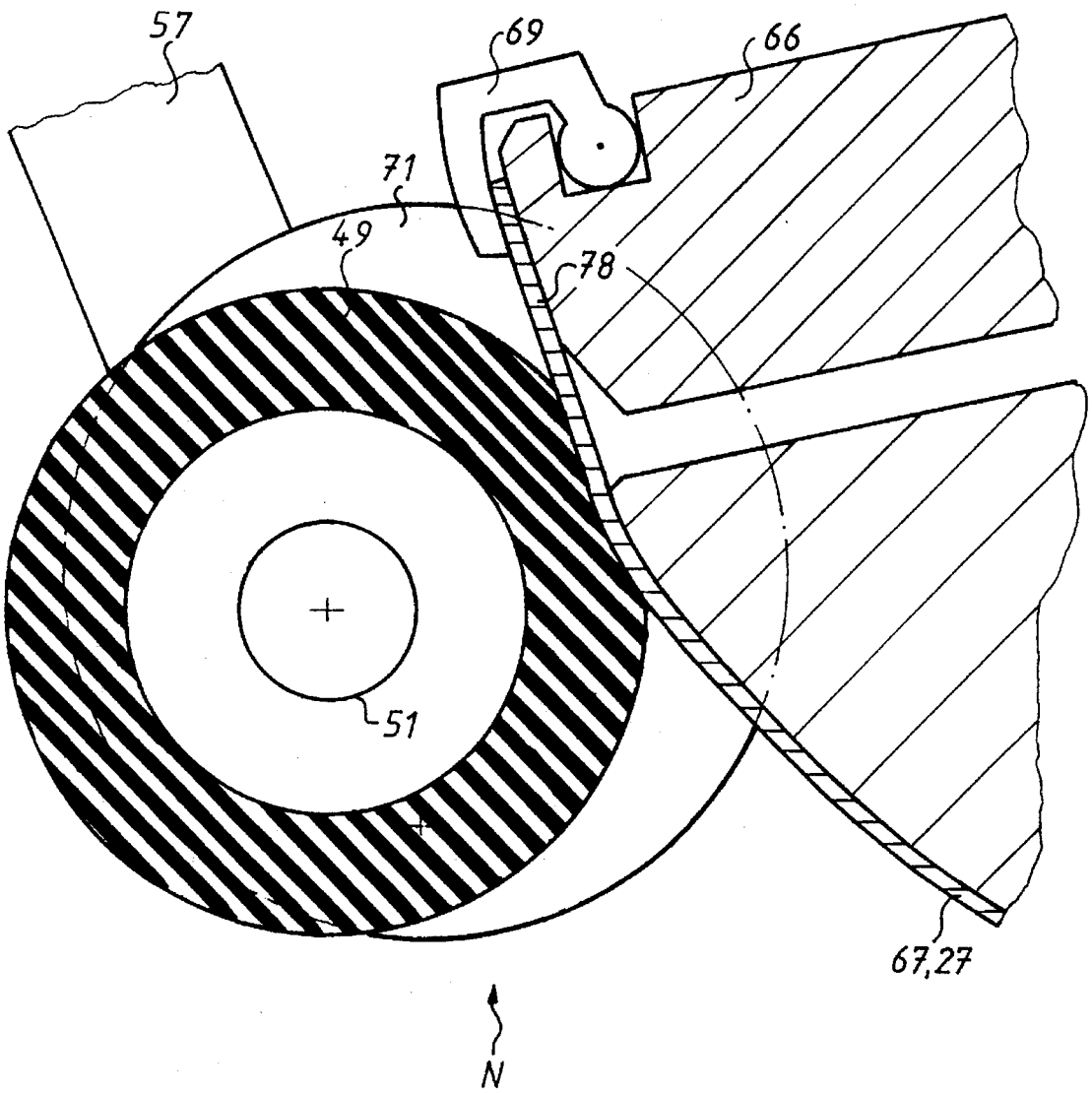
FIG. 5, an enlarged representation of the guide compartment with the cylinder device in the applied position.

In accordance with FIGS. 1, 4 and 5, the plate cylinder 2 has known plate gripping and clamping devices 64, 65 in a cylinder depression, such as are described for example in DE-OS 36 04 071, for clamping a printing plate 67. Also known clamping strips or clamping flaps 68, 69 are provided for this. The actuation of the above mentioned gripping and clamping devices can take place by means of a work medium, for example compressed air, which is supplied via a rotary inlet on the shaft journal of the plate cylinder 2.

In accordance with the representations in FIGS. 2 and 4, eccentric disks 71, 72, which can be fixed in place on the shaft 51, are disposed on the shaft 51 in close vicinity of the levers 52, 53 and respectively cooperate with fixed stops 73, 74 located on the plate cylinder 2.

When the rubber roller 49 is placed against the plate cylinder 2, the eccentric disks 71, 72 run in grooves 76, 77 respectively extending on the circumference of the plate cylinder 2 in the vicinity of its front faces, but without touching the bottom of the grooves. These grooves 76, 77 can also be contained in bearer rings respectively fastened on the front of the plate cylinder 2.

In accordance with the representation in FIG. 4, respectively one detent or fixed stop 73, 74 (.only 74 is shown) for the leading edge of the plate is disposed in the grooves 76, 77 at the front end of the plate gripping and clamping device 64, viewed in the production rotation direction F of the plate cylinder 2, so that in a supply position G of the plate 27 in accordance with FIG. 4 the eccentric disks 71, 72 are in engagement at this location with the detents 73, 74, so that a defined gap of a value "h" is formed between the rubber roller 49 and the jacket surface of the plate cylinder 2 as may be seen in FIG. 4.

The mode of operation of the device is as follows. Corresponding to a removal position K in accordance with FIG. 1 of the printing plate 67 located on the plate cylinder 2, the plate gripping and clamping device 64, 66 is in the position of rest and the clamping bar 69 has released the plate end 78 of the printing plate 67. The roller device 13 is in the removal position K, i.e. the rubber roller 49 has a maximal distance "1" from the plate cylinder 2 or a gap of the width "1" is created between the rubber roller 49 and the plate cylinder 2. The plate end 78 now relaxes into a position distant from the plate cylinder 2 and in the process springs against the rubber roller 49. By means of turning the plate cylinder 2 in a clockwise direction corresponding to the direction of rotation M in FIG. 1, the rubber roller 49 acts as a guide element. By means of continued turning of the plate cylinder 2 in the direction of rotation M, the plate end 78 reaches the guide compartment 12 and passes between the ends 47, 48 of the guide elements 43, 44, which center the plate end 78 by means of the rounded areas 46. Once the printing plate 67 is thus securely guided in the guide compartment 12, the positioning elements or work cylinders 62, 63 are applied, so that the rubber roller 49 closes the gap "1" so that this gap "1" is reduced to 0 and rests against the printing plate 67. This corresponds to an application position N, such as is illustrated in FIG. 5. Because of continued turning of the plate cylinder 2 in the removal direction of rotation M of FIG. 1, the printing plate 67 is conveyed in the direction of the storage compartment 8 and now passes-by the guide plates 31 to 33, which are shown in FIG. 3, and which close off the supply compartment 9. The plate 67 being removed continues in the direction of the arrow D and the guide plates 31 to 33 guide the plate end 78 in the direction of the removal compartment 11 until it touches the guide plates 34 to 36 pointing into the removal compartment 11 and pivots their end 41 away in the direction of the intermediate wall 19, so that the printing plate 67 moves completely into the removal compartment 11.

The press is now positioned into the supply position G, in which it opens the clamping strip 68 for the plate front edge 11 and stops. Now the plate end 78 projects out of the removal compartment 11 and can be pulled out by the operator until the plate front edge has passed the ends 41 of the guide plates 34, 35, 36. These guide plates 34 to 36 now spring back and lock the removal compartment 11.

The plate cylinder 2 is still in the supply position G of FIG. 4. A leading print edge 79 of a printing plate 27 already brought into the supply compartment 9 rests in the standby position on the end 39 of the guide plates 28 to 30 disposed in the radial direction, as seen in FIG. 3. By means of the exertion of a force on the printing plate 27, the guide elements 28 to 30 pivot around the strip 23 and the leading print edge 79 of the printing plate 27 pushes against the guide plates 31 to 33 in the direction of movement C and thus reaches the guide compartment 12. Continuing, the leading print edge 79 passes the guide elements 43, 44 with their ends 47, 48 as well as their tapered areas 46. The printing plate is thus centered and as seen in FIG. 4 comes into engagement with the clamping strip 68 via the gap "h" formed between the periphery of the rubber roller 49 and the periphery of the plate cylinder 2. The leading edge 79 of the printing plate 27 is exactly positioned there by means of known fitting systems. The clamping strip 68 is now closed upon a scanner signal or a sensor system and, following a further scanner signal, the plate cylinder 2 turns in a counterclockwise direction in the production rotation direction F.

The eccentric disks 71, 72 now slide off the detents 73, 74 and continue to run in the grooves 76, 77, so that the rubber roller 49 presses the printing plate 27 firmly on the jacket surface of the plate cylinder 2 by means of the work cylinders 62, 63 (FIG. 5). The plate cylinder 2 now turns until the plate trailing end clamping strip 69 arrives in the vicinity of the rubber roller 49, i.e. in the removal position K. Thereafter the clamping strip 69 is closed and the position elements 62, 63 move the rubber roller 49 away, i.e. they bring it into the removal position K in accordance with FIG. 1. The printing plate 27 is clamped by means of the gripping and clamping devices 64, 66. The plate changing process is now terminated. The positioning elements 62, 63 can be embodied as pneumatic work cylinders.

In accordance with the representations in FIGS. 1 and 2, the device consisting of the storage container 8, the continuing guide compartment 12 and the roller device 13 located on the guide compartment 12 are to be considered a rigid unit 81 which, in case of non-use, i.e. in the position of rest, can be pivoted in front of both cylinders 2, 3, i.e. in front of the plate cylinder 2 and the rubber cylinder 3. This is achieved in that joints 82 to 85 are fastened respectively at the top and bottom of the side edges 17, 18 of the unit 81, which are respectively connected via couplers 87 to 90 with joints 92 to 95 fixed to the frame. The drive takes place via a work cylinder 97, for example a pneumatic cylinder, fixed to the frame, which is fixedly connected via its piston rod and a joint 98 and a lever 99 with the coupler 90 located in the bearing 95.

The coupler 90 is embodied with a bearing as an angle lever which is connected via its first leg with the joint 85 and via a second leg with the joint 98 located on the piston rod of the work cylinder 97. The unit 81 can be pivoted by actuation of the work cylinder 97 along the pivot curves 101, 102 shown in dashed lines in FIG. 1 around the joints 92, 93 and 94, 95 in the direction of the base of the press.

Figure 6:
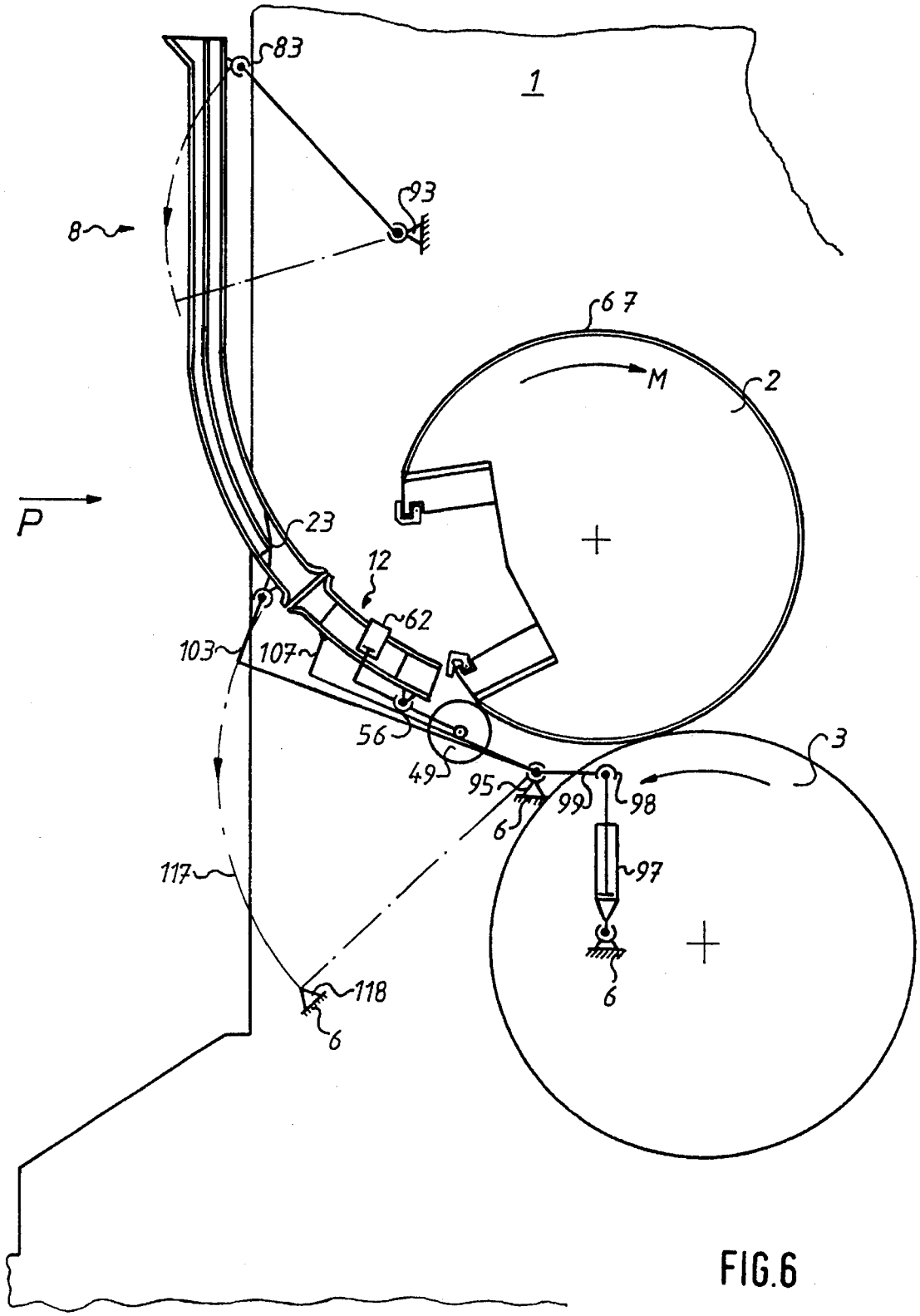
FIG. 6, a second embodiment of the present invention variant in a schematic side view.
Figure 7:
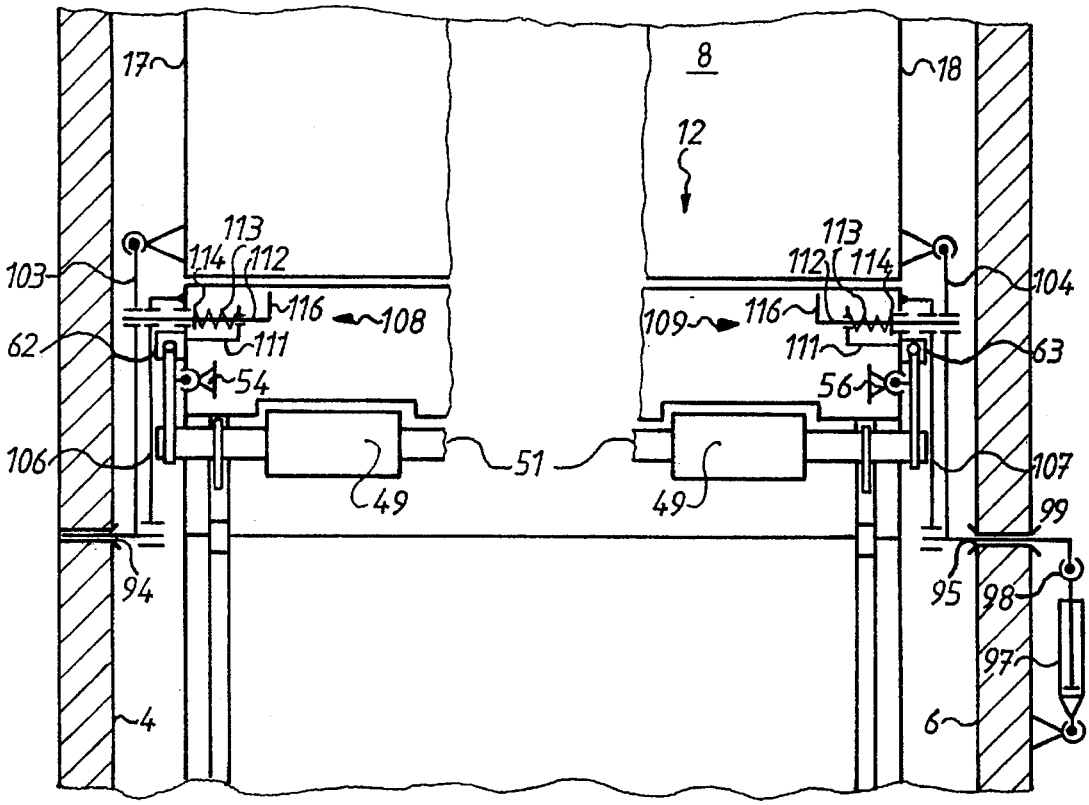
FIG. 7, a view taken in the direction indicated by arrow P in accordance with FIG. 6.

In accordance with a second preferred embodiment represented in FIGS. 6 and 7, the storage container 8 and the guide compartment 12 are disposed so they can be separated from each other.

For this purpose stays 103 104 for the guide compartment 12 are disposed on bearings 94, 95 fixed to the frame, which are fixedly connected with the side edges 17, 18 of the storage container 8. The side edges 17, 18 of the guide compartment 12 are furthermore connected over their entire length with stays 106, 107 which are seated fixed to the frame in the joints 94, 95. On their ends facing away from the joints 94, 95, the stays 106, 107 can be connected with the stays 103, 104 by locking elements 108, 109, which are shown in FIG. 7. The locking elements 108, 109 respectively consist of an elbow 111, which is fastened, for example welded, with the front end of a leg extending in the axial direction, to the stay 106, 107. A pin 112 is disposed parallel with this leg extending in the axial direction, one end of which is seated in a bore of the second leg of the elbow 111 and the other end in a bore of the stay 106, 107. The locking element 108, 109 is permanently maintained in the locking position against the force of a compression spring 113 disposed on the pin 112 and supported on the second leg of the elbow 111 and presses against a disk 114 fastened on the pin 112, i.e. the pin 112 engages a bore in the stay 103, 104, so that the stays 103, 104 are removably connected with the stays 106, 107. The pin 112 is provided with a handle 116, for example a grip, on its end remote from the stays. In this way, it is possible to pivot the non-separated compartments 8, 12, which are analogous with the unit 81 in the representation of FIG. 1, by means of the work cylinder 97 in accordance with the pivot curves 101, 102 shown in dashed lines around the joints 92, 03 and 94, 95 in the direction of the base of the press.

However, it is also possible to separate the stays 103, 104 from the stays 106, 107 by actuating the pins 112 of the locking elements 108, 109, i.e. to unlock them, so that the stays 103, 104 maintain their position, and the stays 106, 107 fixedly connected with the side edges 17, 18 of the guide compartment 12, which at the same time receive the roller device 13, can be pivoted around the joints 94, 95, fixed to the frame, along a pivot curve 117 shown in dashed lines against a detent 118 fixed to the frame. In this way, the plate cylinder 2 is accessible so that the operators can work on this cylinder between and through the stays 103, 104.

However, it is also possible to move the unit 81 vertically, without the pivot curves 101, 102 shown in dashed lines in FIG. 1, in the direction of the base of the press without a change in distance from the side frame 4, in that for example the joints 82, 84 and 83, 85 slide in vertically disposed parallel guides. The drive could take place by means of a pneumatic cylinder.

The positioning elements 62, 63 can be embodied as servo motors or as pneumatic servo cylinders which are moved into several preset positions.

I claim:

1. A device for supplying and removing printing plates in a rotary printing press with a plate cylinder comprising:

a printing plate storage container positioned adjacent said plate cylinder and having an upper portion and a lower portion;

a longitudinally extending intermediate wall dividing said upper portion of said storage container into a plate supply compartment and a plate removal compartment, said intermediate wall having an upper end and a lower end;

an undivided plate guide compartment in said lower portion of said storage container and below said intermediate wall, said plate guide compartment having a lower end terminating adjacent said plate cylinder; and a plurality of guide elements in said storage container and including removal compartment guide elements which act in a blocking manner in a printing plate supply direction, and supply compartment guide elements which act in a blocking manner in a printing plate removal direction.

2. The device in accordance with claim 1 wherein said removal compartment guide elements open in said printing plate removal direction and further wherein said supply compartment guide elements open in said printing plate supply direction.

3. A device in accordance with claim 1 further including guide elements in said lower end of said guide compartment and which have a spacing distance of the width of a printing plate and which are provided with tapered areas with these tapered areas facing each other in said lower end of said guide compartment, said guide compartment further having spaced side walls and said guide elements being secured to said side walls.

4. A device in accordance with claim 1 wherein said supply compartment guide elements are support plates and are disposed transversely to said printing plate supply direction in said plate supply compartment.

5. A device in accordance with claim 1 wherein said supply compartment guide elements are support plates that extend in the direction of said plate cylinder and have one end that rests on an inside surface of a front wall of said plate guide compartment.

6. A device in accordance with claim 1 wherein said removal compartment guide elements are embodied as blocking elements having free ends which extend in the direction of a first upper end of said storage container against the inside of a rear wall of said removal compartment.

7. A device in accordance with claim 1 wherein said storage container and said guide compartment are embodied as separable units.

8. A device in accordance with claim 7 wherein said guide compartment is pivotable around shafts fixed to a frame of said rotary printing press.

* * * * *